United States Patent [19]

Nagafusa et al.

[11] Patent Number: 4,743,728

[45] Date of Patent: May 10, 1988

[54] DUAL PATH AIR CIRCULATION SYSTEM FOR MICROWAVE OVENS

[75] Inventors: Makoto Nagafusa, Nagoya; Yoshitoshi Hirate, Komaki; Minoru Takagi, Tsushima, all of Japan

[73] Assignee: Kabushiki Kaisha Toshiba, Kawasaki, Japan

[21] Appl. No.: 48,881

[22] Filed: May 12, 1987

[30] Foreign Application Priority Data

May 31, 1986 [JP] Japan ..... 61-126368
May 31, 1986 [JP] Japan ..... 61-126369

[51] Int. Cl.[4] ..... H05B 6/64

[52] U.S. Cl. ..... 219/10.55 R; 219/10.55 E; 219/400; 126/21 A

[58] Field of Search ..... 219/10.55 R, 10.55 F, 219/10.55 E, 400; 126/21 A, 21 R

[56] References Cited

U.S. PATENT DOCUMENTS 4,296,297 10/1981 Miller ..... 219/10.55 F
4,369,347 1/1983 Shin ..... 219/10.55 R X
4,556,772 12/1985 McCammon et al. ..... 219/10.55 F
4,618,756 10/1986 Schwaderer et al. ..... 219/10.55 R

FOREIGN PATENT DOCUMENTS 53-1159 1/1978 Japan .

*Primary Examiner*—Philip H. Leung
*Attorney, Agent, or Firm*—Cushman, Darby & Cushman

[57] ABSTRACT

A microwave cooking apparatus includes a cooking chamber and a reflecting chamber disposed on the cooking chamber. The reflecting chamber is provided with a rotatable reflector for reflecting microwaves from a magnetron. The cooking apparatus further includes a fan device for producing cooling air, and a duct device directing a portion of the air to the reflecting chamber for rotating the reflector, and by-passing the reflecting chamber and directing a portion of the air to the cooking chamber for ventilating the cooking chamber. This construction may provide sufficient air to the reflecting chamber and the cooking chamber.

6 Claims, 3 Drawing Sheets

DUAL PATH AIR CIRCULATION SYSTEM FOR MICROWAVE OVENS

BACKGROUND OF THE INVENTION

1. Field of the Invention

The present invention relates, in general, to cooking apparatuses. In particular, the invention relates to a microwave cooking apparatus wherein a magnetron for generating microwaves and a rotatable device for reflecting the microwaves from the magnetron into a cooking chamber are employed.

2. Description of the Prior Art

As is well known, microwave cooking apparatuses, such as microwave ovens, typically include a fan device for cooling electric components, such as, e.g., a magnetron, a transformer, etc., and for ventilating the cooking chamber. The microwave cooking apparatus also generally includes a rotatable reflector arranged between the magnetron and the cooking chamber for reflecting microwaves from the magnetron. The reflector is rotated by the force of cooling air generated by the fan device. Thus, the microwaves reflected by the reflector are uniformly fed to the cooking chamber.

A microwave cooking apparatus of the type described above is disclosed in Japanese Utility Model Laid-open Publication No. 1159/1978, filed June 23, 1976 in the name of Ichiro Hori, and entitled HIGH FREQUENCY HEATING APPARATUS. In this prior art, a reflecting chamber in which a rotatable reflector is disposed is provided on a cooking chamber. Some of the cooling air generated by a fan device is directed to the reflecting chamber. The remaining cooling air is supplied to a magnetron for cooling the magnetron, and then is fed to the reflecting chamber.

Those two cooling airs described above are re-joined in the reflecting chamber so as to rotate the reflector. After that, the re-joined air enters into the cooking chamber, and then it is discharged from the chamber. At this time, the vapor and the grease generated from food during cooking may be exhausted from the cooking chamber together with the cooling air.

In the above-described prior art, a suitable amount of the cooking air generated by the fan device is supplied to the reflecting chamber for rotating the reflector, and then is fed to the cooking chamber. The remaining cooling air also is supplied to the cooking chamber through the magnetron and the reflecting chamber. Therefore, the pressure of the cooling air decreases during the migration described above. As a result, the vapor and the grease from food in the cooking chamber may not be sufficiently exhausted from the cooking chamber because of the low pressure of the cooling air. Thus, a large capacity fan device is needed in this prior art apparatus if the vapor and the grease in the cooking chamber are to be discharged sufficiently. In addition, in this prior art apparatus, recirculation of the exhausted cooling air may occur because its exhaust port is provided close to the intake port.

SUMMARY OF THE INVENTION

It is an object of the present invention to provide sufficient air to the reflecting chamber and the cooking chamber of a microwave cooking apparatus at a sufficient pressure with a fan device having a small capacity fan motor.

It is another object of the present invention to avoid the recirculation of the exhausted air from such a microwave cooking apparatus.

To accomplish the above objects, the microwave cooking apparatus of the present invention includes a heating compartment having a cooking zone and a reflecting zone located above the cooking zone. The microwave cooking apparatus further includes a magnetron for radiating microwaves to the cooking zone through the reflecting zone. A rotatable reflector is disposed in the reflecting zone for reflecting microwaves from the magnetron. The microwave cooking apparatus further includes a fan device for supplying air under pressure into the heating compartment. The fan device includes a duct device separating the supplied air in to at least a first flow path communicating a portion of the air to the reflecting zone for rotating the reflector, and a second flow path bypassing the reflecting zone and communicating a portion of the air to the cooking zone for ventilating the cooking zone.

The microwave cooking apparatus may include a partition wall for defining a reflecting chamber as the reflecting zone and a cooking chamber as the cooking zone in the heating compartment. The reflecting chamber may be provided with an air guide for concentrating the air from the first flow path onto the reflector.

The microwave cooking apparatus further includes an exhausting passage for exhausting the air from the cooking apparatus. The exhausting passage may be provided with a deflection plate for directing the exhausted air from the cooking apparatus.

BRIEF DESCRIPTION OF THE DRAWINGS

The present invention is best understood with reference to accompanying drawings in which.

DETAILED DESCRIPTION OF THE PREFERRED EMBODIMENT

Referring to the accompanying drawings, an embodiment of the present invention will be described.

Figure 1:
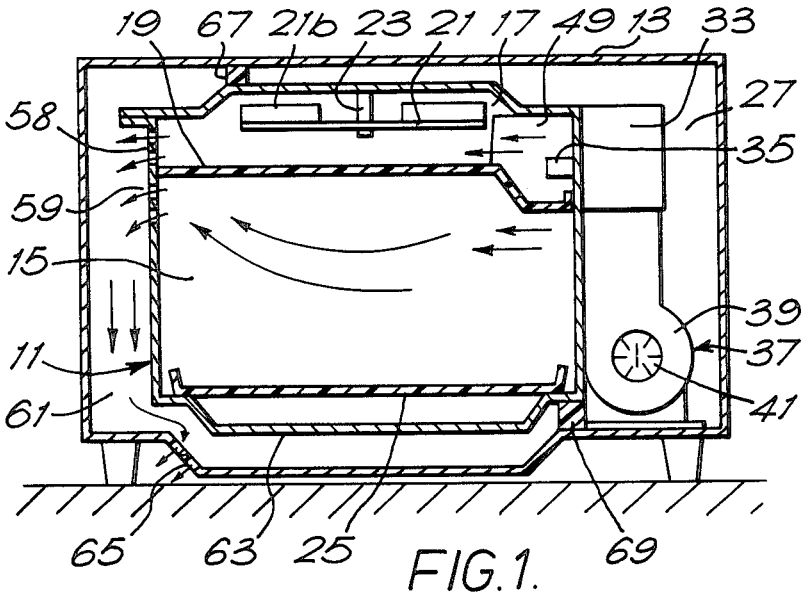
FIG. 1 is a vertical sectional view illustrating a microwave oven according to an embodiment of the present invention.

FIG. 1 is a longitudinal sectional view of a microwave oven of one embodiment. As shown in FIG. 1, a heating compartment 11 is disposed in a oven body 13. Heating compartment 11 is partitioned into a cooking chamber 15 and a reflecting chamber 17 with a plastic partition wall 19 disposed across heating compartment 11. Reflecting chamber 17 is positioned on cooking chamber 15.

Figure 2:
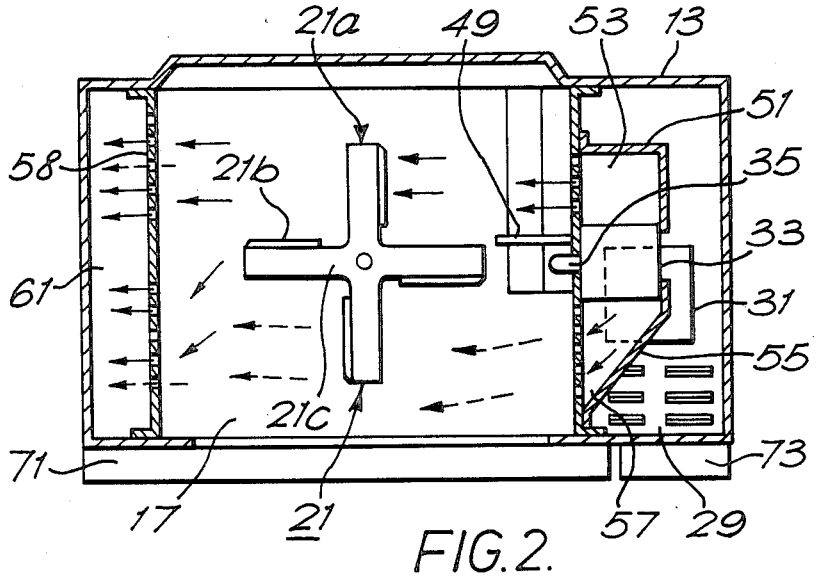
FIG. 2 is a cross-sectional plan view illustrating the microwave oven shown in FIG. 1.

The ceiling of reflecting chamber 17 is upwardly concaved, and thereupon a reflector 21 is rotatably suspended. Reflector 21 includes a cross-shaped deflecting plate 21*a*, as shown in FIG. 2. A perpendicular fan-like blade 21*b* extends upward from the edge of each elongated arm portion 21*c* of cross-shaped deflecting plate 21*a*. Reflector 21 is rotatably supported by a stationary shaft 23 downwardly projecting from the ceiling of reflecting chamber 17.

The bottom portion of cooking chamber 15 is concaved downward, and a tray 25 is laid across the concaved bottom portion of cooking chamber 15.

Figure 3:
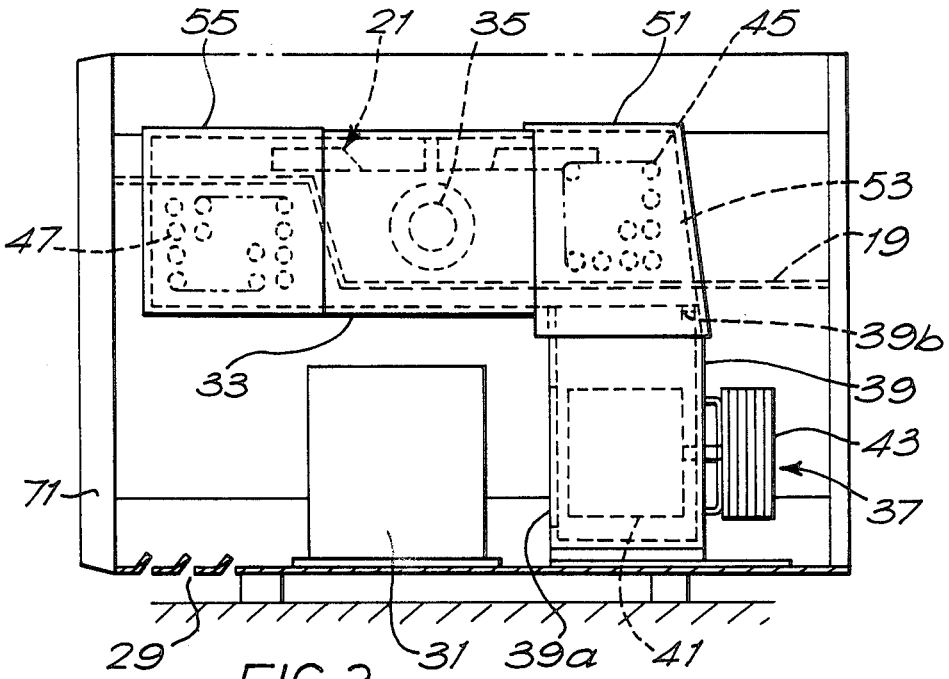
FIG. 3 is a side view of the microwave oven with no outer casing, as shown in FIGS. 1 and 2.

A machinery chamber 27 is established between the right side wall of heating compartment 11 and the outer wall of body 13, as shown in FIGS. 1 and 2. A plurality of air intake holes 29 are formed at the front side of the bottom surface of oven body 13 within machinery chamber 27, as shown in FIGS. 2 and 3. A high-voltage transformer 31 is arranged on the bottom surface of oven body 13 near air intake holes 29.

A magnetron 33 exposed to machinery chamber 27 is mounted on the upper center portion of the right side wall of heating compartment 11. The antenna 35 of magnetron 33 penetrates the right side wall of heating compartment 11, and projects to the inside of reflecting chamber 17.

As can be seen in FIGS. 1 and 3, a fan device 37 is disposed in the area adjacent to transformer 31 in machinery chamber 27. Fan device 37 includes a fan casing 39 in which fan 41 is positioned, and a motor 43 for driving fan 41. Fan casing 39 includes an air intake port 39*a* and an air discharge port 39*b*. Fan casing 39 is arranged in machinery chamber 27 so that air intake port 39*a* faces transformer 31, and air discharge port 39*b* opens upward, as shown in FIGS. 1 and 3.

As shown in FIG. 3, a plurality of first through holes 45 are provided in the side wall of heating compartment 11 at the right-hand side of magnetron 33. A plurality of second through holes 47 are provided to the side wall of heating compartment 11 at the left-hand side of magnetron 33.

Figure 4:
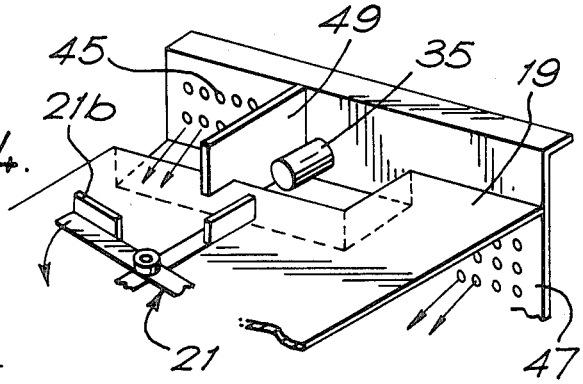
FIG. 4 is a perspective schematic view, partly broken away, illustrating the inside of a reflecting chamber, as shown in FIGS. 1 and 2.

As shown in FIG. 4, the surface area of partition wall 19 adjacent to first through holes 45 and antenna 35 of magnetron 33 is concaved toward cooking chamber 15 to expose first through holes 45 and antenna 35 to reflecting chamber 17. Second through holes 47 are exposed to cooking chamber 15. An air guide plate 49 is disposed between first through holes 45 and antenna 35 of magnetron 33 in reflecting chamber 17.

A first duct cover 51 is provided between magnetron 33 and an discharge port 39*b* of fan casing 39 to establish a first air path 53 therebetween. The air from air discharge port 39*b* of fan casing 39 is supplied to reflecting chamber 17 through first through holes 45 along first air path 53. The air from fan casing 39 is also supplied to magnetron 33.

A second duct cover 55 is provided between magnetron 33 and second through holes 47. A second air path 57 is defined by second duct cover 55 and the side wall of cooking compartment 11. The air from magnetron 33 is guided by second duct cover 55, and is supplied to cooking chamber 15 through second through holes 47. As shown in FIG. 2, the distance between second duct cover 55 and the side wall of heating compartment 11 is preferably gradually reduced from magnetron 33 toward the front side of oven body 13. The air from magnetron 33 may thus concentrate to second through holes 47 by second duct cover 55.

A plurality of third through holes 58 are provided to the left-hand side wall of heating compartment 11 exposed to reflecting chamber 17. A plurality of fourth through holes 59 also are provided to the left-hand side wall of heating compartment 11 exposed to cooking chamber 15. An air discharge path 61 is established between the left-hand side wall of heating compartment 11 and the outer wall of oven body 13. As can be seen in FIG. 1, the bottom surface of oven body 13 facing to the bottom of heating compartment 11 is concaved downward in a rectangular-shape. Each side wall of the concaved portion 63 of the bottom is slanted inward, as shown in FIG. 1. A plurality of air exhausting holes 65 are provided to the left-hand side wall of concaved portion 63.

The air from reflecting chamber 17 through third through holes 58 and the air from cooking chamber 15 through fourth through holes 59 are re-joined in air discharge path 61 into discharge air. To avoid recirculation of the discharge air, the discharge air is exhausted from exhausting holes 65 in the direction opposite to machinery chamber 27 at which air intake holes 29 are provided.

As shown in FIG. 1, to separate machinery chamber 27 and air discharge path 61 airtightly, an elongated bar material 67 is fixed between the upper wall of oven body 13 and the ceiling of heating compartment 11. An elongated bar material 69 also is provided between the bottom wall of oven body 13 and the bottom surface of heating compartment 11. The both side walls and upper and lower walls of heating compartment 11 may thus extend between the front and rear walls of oven body 13, as shown in FIG. 3. A front door 71 also is hinged at the front side of oven body 13 to open and close cooking chamber 15, as shown in FIG. 2.

The operation of the above-described embodiment will be described hereafter.

First, food is arranged on tray 25. A desired cooking time is set through an operation panel 73 on which start and stop keys, a cooking time setting knob, etc. are provided. When the start key (not shown) is operated, magnetron 33 is energized through transformer 31. Microwaves generated by magnetron 33 are supplied to reflecting chamber 17 from antenna 35 of magnetron 33.

In response to the operation of the start key, motor 43 of fan device 37 also is energized. Cooling air is taken from the atmosphere into machinery chamber 27 through air intake holes 29. Since high-voltage transformer 31 is positioned between air intake holes 29 and fan device 37, transformer 31 may be cooled by the cooling air from air intake holes 29.

After cooling transformer 31, the cooling air is directed into fan casing 39. The cooling air is supplied to the first air path 53 from air discharge port 39*b* of fan casing 39. The cooling air is divided into driving air and ventilating air in first air path 53. The driving air enters into reflecting chamber 17 through first through holes 45. The driving air concentrates on fan-like blade 21*c* of reflector 21 by air guide plate 49. Thus, the driving air rotates reflector 21 in the reflecting chamber for scattering microwaves fed from antenna 35 of magnetron 33. The scattered microwaves are applied to the food on tray 25 through partition wall 19. As a consequence, the food may be heated uniformly. Then, the driving air goes out into air discharge path 61 through third through holes 58 of reflecting chamber 17.

The ventilating air moves around magnetron 33 for cooling magnetron 33, and then reaches second air path 57. The ventilating air enters into cooking chamber 15 through second through holes 47 of cooking chamber 15. Then, the ventilating air goes out into air discharge path 61 through fourth through holes 59 of cooking chamber 15. When the ventilating air is discharged from cooking chamber 15, the ventilating air conveys the vapor and the grease from the food to the outside of cooking chamber 15.

Figure 5:
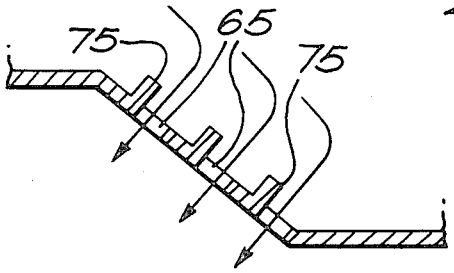
FIG. 5 is an enlarged sectional view illustrating another example of an air exhausting port of the present invention.

As can be understood from FIGS. 1 and 2, the driving air and the ventilating air are re-joined in air discharge path 61 to become discharge air. The discharge air finally goes out from oven body 13 through exhausting holes 65. It should be noted here that a plurality of deflecting plates 75 may be provided near exhausting holes 65 for effectively exhausting the discharge air from exhausting holes 65 away from machinery chamber 27 at which air intake holes 29 are provided, as shown in FIG. 5.

According to the embodiment described above, the cooling air generated by the fan device is divided into driving air for rotating the reflector in reflecting chamber and ventilating air for ventilating the cooking chamber. The driving air directly enters into the reflecting chamber.

The ventilating air by-pass the reflecting chamber and enters into the cooking chamber through a magnetron. Therefore, appropriate air for each chamber may be supplied. Pressure loss of the ventilating air also may be reduced, as compared with the prior art described above. Generally, fan efficiency of a fan device is enhanced as a pressure loss reduces. Therefore, in this embodiment, a small capacity fan motor may be used for rotating the reflector and for ventilating the cooking chamber.

An experiment was carried out to prove the above-described effects. According to this experiment, desirable results are confirmed even though the thickness of a fan motor core used for the conventional fan device is reduced from 20 mm to 16 mm.

The present invention has been described with respect to a specific embodiment. However, other embodiments based on the principles of the present invention should be obvious to those of ordinary skill in the art. Such embodiments are intended to be covered by the claims.

What is claimed is:

1. A microwave cooking apparatus comprising:

outer casing means having a bottom surface;

heating compartment means for receiving food to be cooked, the heating compartment means having a reflecting zone and a cooking zone;

means for generating microwaves radiated to the reflecting zone in the heating compartment means;

rotatable reflecting means in the reflecting zone for reflecting the microwaves onto the food in the cooking zone;

fan means for supplying air under pressure into the heating compartment means, the fan means including duct means separating the supplied air into at least a first flow path communicating a portion of the air to the reflecting zone for rotating the reflecting means, and into a second flow path bypassing the reflecting zone and communicating a portion of the air to the cooking zone for ventilating the cooking zone;

air intake opening means provided in the bottom surface of the outer casing means for communicating air from the outside of the cooking apparatus to the fan means; and exhausting passage means for exhausting air from the heating compartment means to the outside of the cooking apparatus, the exhausting passage means including outward convex portion means provided on the bottom surface of the outer casing means for directing the exhausted air away from the air intake opening means.

2. An apparatus according to claim 1, wherein the duct means includes means for concentrating the air from the first flow path onto the reflecting means.

3. An apparatus according to claim 1, wherein the heating compartment means includes partition means for separating the cooking zone from the reflecting zone.

4. A microwave cooking apparatus comprising:

an outer casing having a bottom wall;

a heating compartment disposed in the outer casing, the heating compartment having opposite side walls and an upper portion;

a reflection chamber disposed in the upper portion of the heating compartment;

a reflection device rotatably supported in the reflection chamber;

a cooling fan for supplying cooling air to the heating compartment;

an air intake opening provided in the bottom wall of the outer casing in the vicinity of the cooling fan;

a first air duct for communicating a part of the cooling air from the cooling fan to the reflection chamber for rotating said reflection device, the first air duct including a side wall in common with the heating compartment;

a second air duct also including a side wall in common with the heating compartment, one end of the second air duct bypassing the reflection chamber and communicating a part of the cooling air to the heating compartment, the other end being connected to the first air duct for fluid communication therewith;

an exhausting duct in common with the opposite side wall of the heating compartment from the cooling fan for exhausting the cooling air from the reflection chamber and heating compartment to the outside of the cooking apparatus, the exhausting duct including an air exhausting opening;

a magnetron arranged within the second air duct for generating microwaves; and an outward convex portion formed on the bottom wall of the outer casing, the convex portion fluidly communicating with the exhausting duct for directing the cooling air away from the intake opening.

5. An apparatus according to claim 4, wherein the convex portion has side walls, and the convex portion includes an exhausting opening at the side wall of the convex portion opposite to the air intake opening.

6. An apparatus according to claim 5, wherein the convex portion includes an air guide plate in the vicinity of the exhausting opening for deflecting the exhausted air away from the air intake opening.

* * * * *